US007594714B2

(12) United States Patent
Katayama

(10) Patent No.: US 7,594,714 B2
(45) Date of Patent: Sep. 29, 2009

(54) INKJET PRINTER HEAD

(75) Inventor: Naoki Katayama, Kariya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 328 days.

(21) Appl. No.: 11/231,460

(22) Filed: Sep. 21, 2005

(65) Prior Publication Data

US 2006/0066690 A1 Mar. 30, 2006

(30) Foreign Application Priority Data

Sep. 28, 2004 (JP) ..... 2004-281516

(51) Int. Cl.
*B41J 2/045* (2006.01)

(52) U.S. Cl. ..... 347/68; 347/71

(58) Field of Classification Search ..... 347/71, 347/70, 72, 47

See application file for complete search history.

(56) References Cited

U.S. PATENT DOCUMENTS

| | | | | |
|---|---|---|---|---|
| 5,670,999 | A * | 9/1997 | Takeuchi et al. | 347/70 |
| 6,074,040 | A * | 6/2000 | Usui et al. | 347/45 |
| 6,193,360 | B1 * | 2/2001 | Nishiwaki et al. | 347/70 |
| 2002/0105567 | A1 * | 8/2002 | Yamada et al. | 347/87 |
| 2004/0056937 | A1 | 3/2004 | Ito | |
| 2005/0078144 | A1 * | 4/2005 | Yamada et al. | 347/30 |

FOREIGN PATENT DOCUMENTS

| | | | |
|---|---|---|---|
| EP | 1 093 919 | | 4/2001 |
| EP | 1 375 148 | | 1/2002 |
| JP | 60071259 | A * | 4/1985 |
| JP | 6-84081 | | 10/1994 |
| JP | 8-9231 | | 1/1996 |
| JP | 09314836 | | 12/1997 |
| JP | 2833945 | | 10/1998 |
| JP | 3018642 | | 1/2000 |
| JP | 3402349 | | 2/2003 |
| JP | 2004-25636 | | 1/2004 |

* cited by examiner

*Primary Examiner*—Matthew Luu
*Assistant Examiner*—Lisa M Solomon
(74) *Attorney, Agent, or Firm*—Reed Smith LLP

(57) ABSTRACT

An inkjet printer head for performing recording by ejecting ink onto a recording medium, has: a cavity unit including a plurality of nozzle holes for ejecting the ink, a plurality of pressure chambers communicating with each of the nozzle holes, and a manifold that temporarily accumulates the ink that is supplied to the pressure chambers; and actuators that eject the ink from the nozzle holes. The cavity unit contains at least a laminate having a nozzle film made of a synthetic resin and provided with said plurality of nozzle holes, a reinforcement plate stuck onto one face of the nozzle film and arranged facing the recording medium, and a manifold plate stuck onto the other face of the nozzle film and provided with manifold holes constituting the manifold. The reinforcement plate is provided with a through-hole passing therethrough facing each nozzle hole, and a recess that opens facing the manifold holes through the nozzle film.

14 Claims, 10 Drawing Sheets

INKJET PRINTER HEAD

BACKGROUND OF THE INVENTION

1. Field of the Invention

The present invention relates to an inkjet printer head.

2. Description of the Related Art

As a recording device for performing recording onto a recording medium such as paper, conventionally known is an inkjet printer in which recording is effected by ejecting ink onto the recording medium. As shown in FIG. 5, a known head that is employed in such an inkjet printer, i.e., an inkjet printer head has: a cavity unit 201 including a plurality of nozzle holes 11*a* used for ejecting ink, a plurality of pressure chambers 19*a* communicating with each of the nozzle holes 11*a* and a manifold (manifold holes 14*a*, 15*a*) that temporarily accumulates the ink that is to be supplied to these pressure chambers 19*a;* and piezoelectric actuators 22 that eject ink from the nozzle holes 11*a*.

The cavity unit 201 includes a laminate comprising a nozzle film 11 and a plurality of plates. In this laminate, a spacer plate 12, a damper plate 13, two manifold plates 14, 15, a supply plate 16, an aperture plate 17, a base plate 18 and a cavity plate 19 are respectively superimposed and joined by adhesive. Communicating holes 16*a*, 18*a* and a communicating path 17*a* for effecting communication of the manifold holes 14*a*, 15*a* with the pressure chamber 19*a;* and communicating holes 12*a*, 13*b*, 14*b*, 15*b*, 16*b*, 17*b* and 18*b* for effecting communication of the pressure chamber 19*a* with the nozzle holes 11*a* are formed in each of the plates. Recesses 13*a* constituting damper chambers for damping the vibration of ink in the manifold are formed in the damper plate 13. These recesses 13*a* have apertures facing the nozzle film 11.

This inkjet printer head is manufactured as shown in FIG. 6. Specifically, a rectangular-shaped nozzle film 11 is obtained by cutting a polyimide film 11' with a thickness of 75 μm that is subjected to water-repellent treatment beforehand on one side thereof constituting the nozzle material to match the region of formation of the nozzle holes. After this, this nozzle film 11 is stuck onto a spacer plate 12 (see FIG. 7A), that is provided with through-holes 12*a* for processing nozzle holes 11*a*, and, using an excimer laser, this nozzle film 11 is then provided with nozzle holes 11*a*, from the side of the spacer plate 12. Specifically, as shown in FIG. 7B, the nozzle holes 11*a* are formed in positions corresponding to the through-holes 12*a*. The reason for processing the nozzle holes by sticking a spacer plate 12 onto the nozzle film 11 in this way is in order to prevent variations of the precision of nozzle position due to expansion/contraction of the nozzle film 11 (caused by heating or moisture absorption).

After this, the laminate part 200 constituted by sticking together the seven plates 13 to 19 subjected to etching processing beforehand, a filter 23 for removal of dust in the ink supplied from an ink tank (not shown), and piezoelectric actuators 22 and a flexible wiring substrate 25 having a drive IC 24 are stuck together or welded onto the side of the spacer plate 12 to constitute the inkjet printer head.

An inkjet printer head constituted by successively laminating, from the side of the recording medium (paper) in this way a nozzle film, a plurality of intermediate plates, and piezoelectric actuators is already known (see for example, Japanese Patent Application Laid-open No. 2004-025636 (paragraphs 0014 to 0020 and FIGS. 2 and 4).

SUMMARY OF THE INVENTION

When an inkjet printer head is constructed using a plurality of intermediate plates in addition to the nozzle film and/or piezoelectric actuators, the cost increases with increase in the number of intermediate plates.

Also, typically, a water-repellent film is applied to the nozzle face of the nozzle film (i.e., the face nearest the recording medium) in order to prevent ink droplets from adhering thereto. This water-repellent film is easily damaged by so-called paper friction i.e., friction with the edges of printing sheets that have become bent backward, or with paper jams. If the water-repellent film in the vicinity of the nozzles holes becomes damaged, ink droplets adhere in the vicinity of the nozzle holes, giving rise to problems such as poor discharge (no discharge, bending or other problems) or contamination of the surface of the recording medium such as a printing sheet.

The likelihood of paper friction as described above has increased in recent years as a result of the reduction in the size of inkjet printers. That is, (i) if a system is adopted in which paper is fed from the lower portion at the front of the printer, with the reduction in size of the paper feed roller in this system, the recording medium is subjected to considerable bending, so there tends to be considerable bending back of the recording medium; and (ii) if, as a result of the demand for so-called borderless printing, in which printing is performed also in the vicinity of the left and right side edges of the recording medium, in order to secure a wide printing range, the paper holding plate that holds the left and right side edges of the recording medium is dispensed with, the likelihood of paper friction as described above increases due to causes such as increased buckling of the side edges of the recording medium.

Accordingly, in order to avoid such paper friction, consideration has been given to providing a cover plate at the nozzle face. However, in recent years, a plurality of nozzle rows are constituted so as to discharge ink of a plurality of colors, so in order to form nozzle holes over a wide range of area, the nozzle film also becomes of substantially the same size as the external shape of the head. Consequently, it becomes substantially difficult to secure a region where a cover plate to protect the nozzle face may be mounted. Also, since the water-repellent film is formed by applying water-repellent film over the entire surface of the nozzle film, for this reason also, it is not possible to mount a cover plate in a region of the nozzle film where there are no nozzle rows.

An object of the present invention is to provide an inkjet printer head wherein it is possible to protect the nozzle face from friction with the recording medium such as a printing sheet, without increasing the number of components thereof.

The present invention provides an inkjet printer head for performing recording by ejecting said ink onto a recording medium, including: a cavity unit including a plurality of nozzle holes for ejecting ink, a plurality of pressure chambers communicating with each of said nozzle holes, and a manifold that temporarily accumulates the ink that is supplied to said pressure chambers; and actuators that eject the ink from said nozzle holes, wherein:

said cavity unit includes at least a laminate having a nozzle film made of a synthetic resin and provided with said plurality of nozzle holes, a reinforcement plate stuck onto one face of said nozzle film and arranged facing said recording medium, and a manifold plate stuck onto the other face of said nozzle film and provided with manifold holes constituting said manifold; and said reinforcement plate is provided with a through-hole passing therethrough facing each said nozzle hole, and a recess that opens facing said manifold holes through said nozzle film. The actuators may be of any type which can apply energy to ink in the pressure chambers, the energy being such that the ink is allowed to be ejected from the nozzle holes. Examples of the actuators include of piezo type utilizing a piezoelectric device, of bubble type (thermal type) utilizing an electric-thermal transducer, of static electrical type utilizing static electrical power, of vibration type utilizing a mechanical machine capable of imparting vibration to the pressure chambers, and of electromagnetic type utilizing electromagnetic force. In this way, since the recesses that open facing the manifold holes, through the nozzle film therebetween, are formed in the reinforcement plate, and these recesses are arranged to function as damper chambers for damping vibration of the ink in the manifold through the nozzle film, it becomes possible to dispense with the damper plate (plate 13 in FIG. 5) that was conventionally considered necessary between the manifold plate provided with manifold holes (manifold spaces) and nozzle film. Accordingly, the number of components (number of plates) can be reduced.

In this case, these recesses that function as damper chambers face the manifold (manifold holes) through a nozzle film made of synthetic resin of high damping effect, so ink vibration in the manifold can be damped without difficulty.

Also, since in this way the recesses of the reinforcement plate function as damper chambers, the damper plate that was conventionally regarded as necessary between the manifold plate provided with the manifold holes (manifold spaces) and the nozzle film can be dispensed with.

In the inkjet printer head of the present invention, it is preferable that, when viewed in the direction of lamination of the laminate, the through-holes have an aperture area larger than the nozzle holes and the recesses have the same shape and the same size as the manifold holes.

In this way, since the through-holes are of larger aperture area than the nozzle holes when seen in the lamination direction of the laminate, the operation of forming the nozzle holes through the through-holes is easy.

Also, since the recesses have the same shape and the same size as the manifold holes and are provided in a portion where there are no through-holes, the damper chambers (recesses) can be formed in the reinforcement plate without impairing the inkjet printer head function.

In the inkjet printer head of the present invention, it is preferable that the recesses form damper chambers that are sealed by one face of the nozzle film and elastic members such as silicone sealing members are enclosed with these damper chambers.

In this way, since such elastic members are enclosed with the damper chambers, penetration of air to the manifold through the nozzle film made of synthetic resin, or evaporation of moisture from the manifold, can be prevented. Also, since such elastic members are enclosed with the damper chambers (recesses), the rigidity of the reinforcement plate is increased.

In the inkjet printer head present invention, it is preferable that a construction is adopted wherein the aperture area of through-holes become larger gradually or in stepwise fashion towards the outside.

Since in this way the through-holes that are formed passing through the reinforcement plate arranged facing the recording medium become of larger aperture area gradually or in stepwise fashion towards the outside, facing the nozzle holes, it becomes easy to remove the residual ink in the vicinity of the nozzle holes to the outside through the through-holes.

In the inkjet printer head of the present invention, it is preferable that, one through-hole is provided for a plurality of adjacent nozzle holes.

In this way, processing of the through-holes becomes easy, since one through-hole can be provided even if the nozzle holes are arranged adjacently in a zigzag fashion. Also, since the aperture area of the through-holes becomes large, the wiper for cleaning the nozzle face can easily penetrate into the through-holes, i.e., the cleaning performance in regard to the vicinity of the nozzle holes (so-called wiping performance) is further improved.

In the inkjet printer head of the present invention, it is preferable that, the reinforcement plate is provided with a water-repellent film at least on the inside of the through-holes.

In this way, even though the reinforcement plate is provided with a water-repellent film at least on the inside of the through-holes, it is difficult for the bent back ends of a recording medium or a paper jam to penetrate inside the through-holes, so the risk of damage to the water-repellent film by friction with the paper surface is reduced. Consequently, since the risk of damage to the water-repellent film is reduced, problems such as poor discharge (no discharge, bending or other problems) or contamination of the recording surface of the recording medium (printing sheet) caused by adhesion of the ink droplets to the vicinity of the nozzle holes can be suppressed.

Due to the adoption of the above construction, since, according to the present invention, recesses that open facing the manifold holes through the nozzle film are formed in the reinforcement plate that protects the nozzle face and these recesses are made to function as damper chambers (that damp vibration of the ink in the manifold through the nozzle film), the damper plate that was conventionally deemed to be necessary between the nozzle film and the manifold plate, in which the manifold holes (manifold spaces) were formed, can be eliminated, and the number of components (number of plates) can be reduced.

In addition, the present inversion provides an inkjet printer having the above-mentioned inkjet printer head.

DESCRIPTION OF THE PREFERRED EMBODIMENTS

Embodiments of the present invention are described below with reference to the drawings.

Figure 1A:
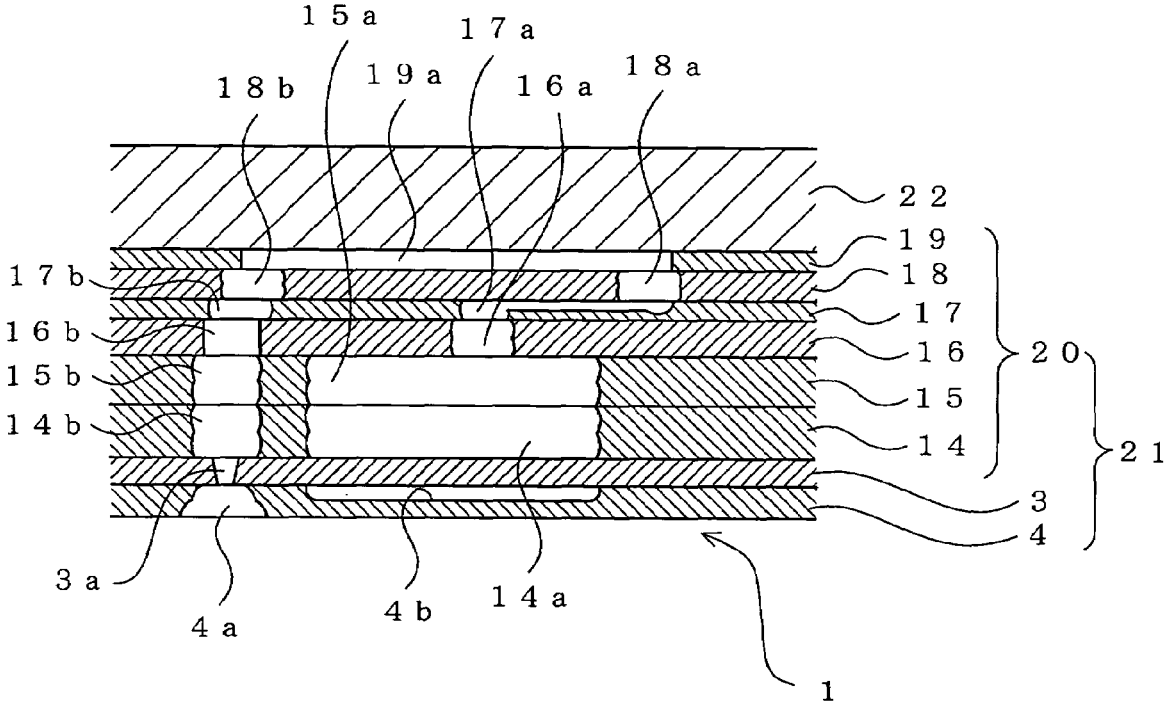
FIG. 1A is a cross-sectional view showing the construction of an inkjet printer head according to one embodiment of the present invention.

FIG. 1A is a cross-sectional view showing an inkjet printer head of according to one embodiment of the present invention.

In FIG. 1A, an inkjet printer head 1 is used to effect recording onto a recording medium by ejecting ink and comprises a cavity unit 21 of rectangular plate shape including a plurality of nozzle holes 3*a* that eject ink, a plurality of pressure chambers 19*a* communicating with each of the nozzle holes 3*a*, and a manifold (manifold holes 14*a*, 15*a*) that temporarily accumulate ink that is supplied to these pressure chambers 19*a*, and piezoelectric actuators 22 (for example piezo elements) for ejecting ink from the nozzle holes 3*a*. In the cavity unit 21, eight rows of the pressure chambers 19*a* are formed where a plurality of the pressure chambers 19*a* are arranged in the longitudinal direction. In accordance with the eight rows of the pressure chambers 19*a*, eight manifolds are formed extending in the longitudinal direction. With respect to arrangement of the rows of the pressure chambers 19*a*, of the eight rows, two rows adjoining each other are arranged in a zigzag fashion, and the two rows constitute one group. Accordingly, the pressure chambers 19*a* are divided into four groups. The cavity unit 21 has four groups of the nozzles holes 3*a* in accordance with the four groups of the pressure chambers 19*a*. In each group of the nozzle holes 3*a*, the nozzle holes 3*a* are arranged in a zigzag fashion and constitutes two rows of the nozzles adjoining each other. The cavity unit 21 is constituted as a laminate by sequentially laminating from the top a laminate part 20 constituted by sticking together with adhesive six intermediate plates (two manifold plates 14, 15, a supply plate 16, an aperture plate 17, base plate 18 and cavity plate 19), a nozzle film 3 provided with a plurality of nozzle holes 3*a* that eject ink, and a cover plate 4.

The inkjet printer head 1 is manufactured by joining the various elements of the cavity unit 21 and the piezoelectric actuators 22 by means of adhesive and, in addition, joining a flexible wiring substrate 25 for supplying drive signals to the upper surface of the piezoelectric actuators 22. This inkjet printer head 1 is releasably mounted on a carriage, not shown. When recording is performed by ejecting ink onto the recording medium, this inkjet printer head 1 performs reciprocal movement in the main scanning direction synchronized with feed of the recording medium. Drive signals based on the printing data are supplied to this inkjet printer head 1 by the flexible wiring substrate 25, which is connected with a control circuit board. In response to this, the piezoelectric actuators 22 of the inkjet printer head 1 supply discharge energy to the ink in the pressure chambers 19*a*. The ink is then discharged from the nozzle holes 3*a* corresponding to these pressure chambers 19*a*.

Each of the plates 14 to 19 that constitute the laminate part 20 is a plate made of 42% nickel alloy steel plate and has a thickness of about 50 μm to 150 μm. In these plates 14 to 19, there are formed by a processing method such as electrolytic etching, laser processing or plasma jet processing a plurality of pressure chambers 19*a*, and manifold holes 14*a*, 15*a* constituting a manifold that temporarily stores ink that is supplied to these pressure chambers 19*a*. Also, communicating holes 16*a*, 18*a* and communicating paths 17*a* for effecting communication of the manifold holes 14*a*, 15*a* with the pressure chambers 19*a*, and, in addition, communicating holes 14*b*, 15*b*, 16*b*, and 17*b* for effecting communication of the pressure chambers 19*a* with the nozzle holes 3*a*, are formed by the same processing method.

That is, as shown in FIG. 1A, the pressure chambers 19*a* are formed in the cavity plate 19 of the uppermost layer and the manifold holes 14*a*, 15*a* are respectively formed in the manifold plates 14, 15 that are located in a lower layer. Also, by laminating and sticking together the plates 14 to 19, channels connecting the nozzle holes 3*a* and the pressure chambers 19*a*, and channels connecting these pressure chambers 19*a* and the manifold are formed within the laminate part 20. Specifically, a plurality of individual ink flow paths are formed from the manifold through the pressure chambers 19*a* to the nozzle holes 3*a*. The edge of the manifold on the ink supply side communicates with an external ink tank through a filter 23. It should be noted that the manifold plate 14 is arranged in the lowermost layer of the laminate part 20, and is provided with respective communicating holes 14*b* that communicate with the manifold holes 14*a* and nozzle holes 3*a*. The manifold holes 14*a* extend in the longitudinal direction (auxiliary scanning direction) of the laminate part 20 and a plurality of communicating holes 14*b* are formed in row fashion along these manifold holes 14*a*. Also, the manifold holes 14*a* of these manifold plates 14 are sealed by the nozzle film 3.

In the nozzle film 3, there are formed nozzle holes 3*a*, corresponding to the communicating holes 14*b* of the manifold plates 14, of minute diameter (about 25 μm in the case of this embodiment) for ejecting ink. In this embodiment, these are provided in a plurality of rows along the long side direction in the nozzle film 3.

A cover plate 4 (reinforcement plate) that is arranged facing the recording medium (printing paper) is stuck onto one face of the nozzle film 3, which is made of synthetic resin and is provided with a plurality of nozzle holes 3*a*. The manifold plate 14, which is provided with manifold holes 14*a* constituting the manifold, is stuck onto the other face of the nozzle film 3. Part of the laminate included in the cavity unit 21, which is one of the characteristic features of the present invention, is constituted by this cover plate 4, nozzle film 3 and manifold plate 14. This cover plate 4 has a thickness of about 50 μm and is made of 42% nickel alloy steel plate, as in the laminate part 20 described above.

Figure 3A:
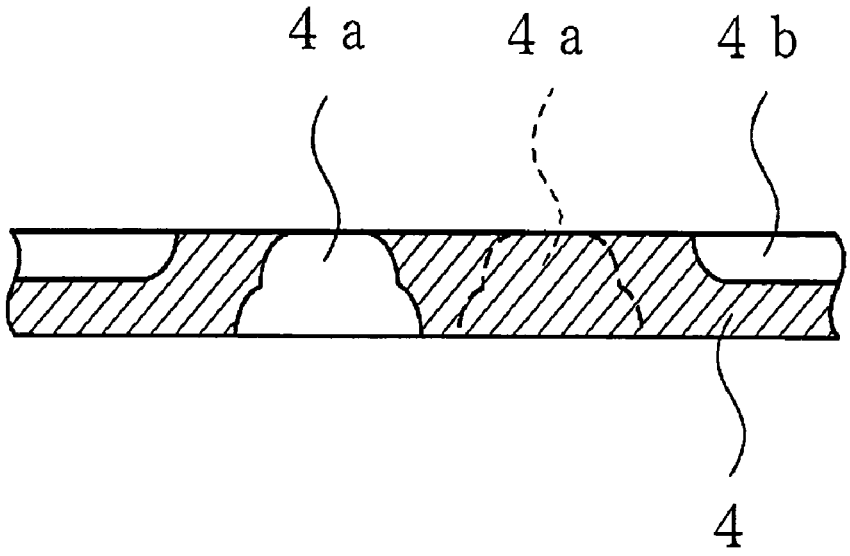
FIG. 3A is a cross-sectional view along the line A-A of FIG. 2

As shown in FIG. 3A, through-holes 4*a* of concentrically circular shape are formed corresponding to the positions of the nozzle holes 3*a* in the cover plate 4 (reinforcement plate). The diameters of these through-holes 4*a* are formed larger than the diameter of the nozzle holes 3*a*. In this embodiment, the aperture diameter on the side of the nozzle film 3 is made about four times the diameter of the nozzle holes 3*a*. Also, although it is desirable that the through-holes 4*a* are of a construction gradually increasing in aperture diameter (aperture area) towards the side of the recording medium, in this embodiment, the aperture diameter (aperture area) of these through-holes increases in two steps towards the recording medium. Also, one through-hole 4*a* is formed in respect of one nozzle hole 3*a*.

Figure 5:
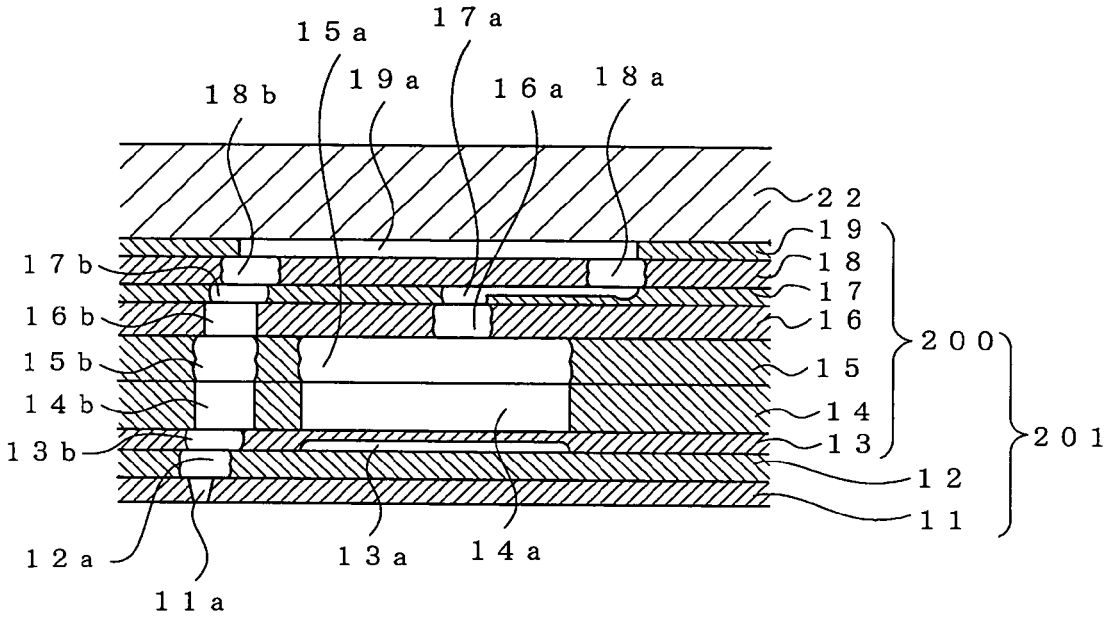
FIG. 5 is a cross-sectional view showing the construction of a prior art inkjet printer head.
Figure 6:
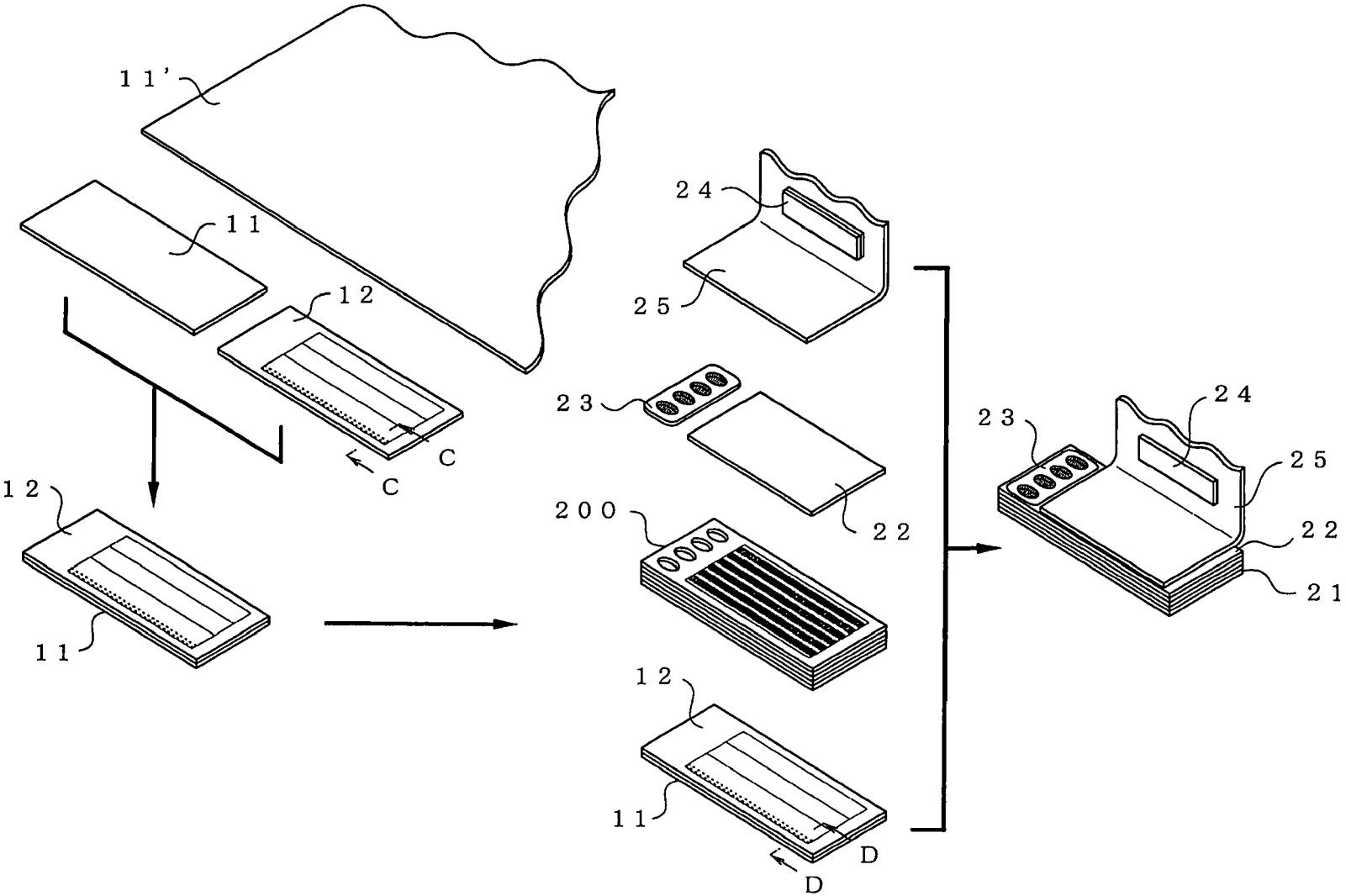
FIG. 6 is a diagram showing a prior art method of manufacturing an inkjet printer head.
Figure 7A:
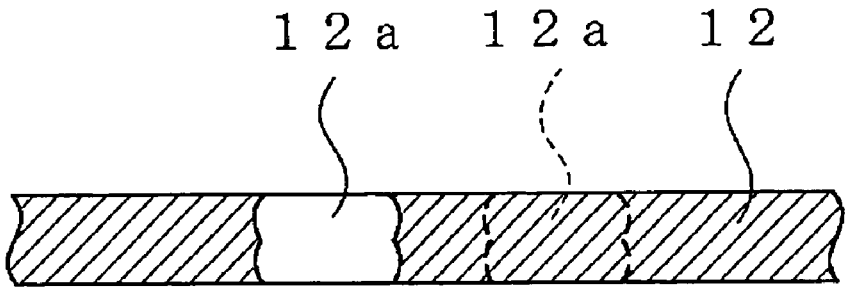
FIG. 7A is a cross-sectional view along the line C-C of FIG. 6
Figure 7B:
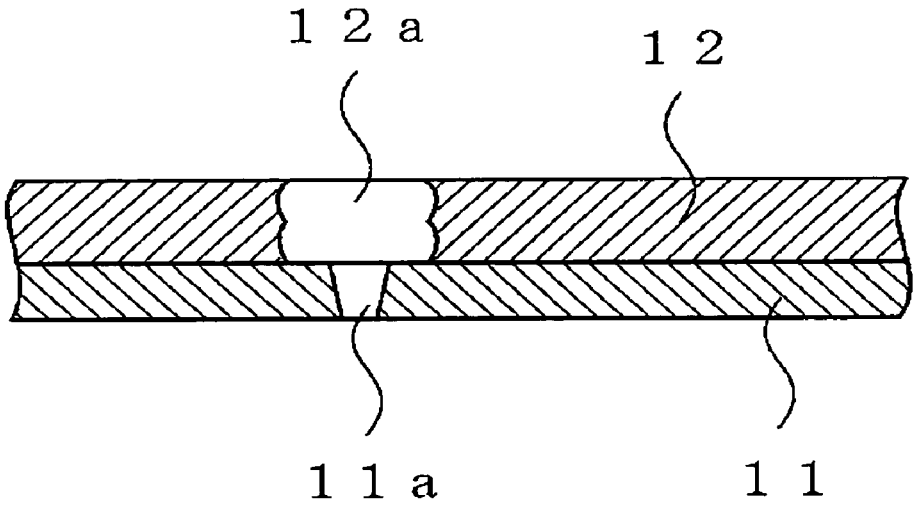
FIG. 7B is a cross-sectional view along the line D-D of FIG. 6.

Furthermore, recesses 4*b* are formed in the cover plate 4, leaving a ceiling section of reduced thickness on the underside thereof. These recesses 4*b* function as damper chambers that open facing the upper nozzle film 3 and the manifold holes 14*a*, 15*a*. Consequently, since the nozzle film 3 thus also functions as a damper plate, the damper plate 13 (see FIG. 5) that was conventionally deemed to be necessary can be dispensed with. It should be noted that the recesses 4*b* may suitably have a depth such that they cannot interfere with the displacement of the nozzle film 3 that provides the damping action.

When seen in the lamination direction (direction orthogonal to the head) of the laminate, the recesses 4*b* have the same shape as the manifold holes 14*a*, 15*a* and are of the same size (aperture area). The plurality of through-holes 4*a* are arranged adjacently in row fashion along these recesses 4*b*.

Figure 2:
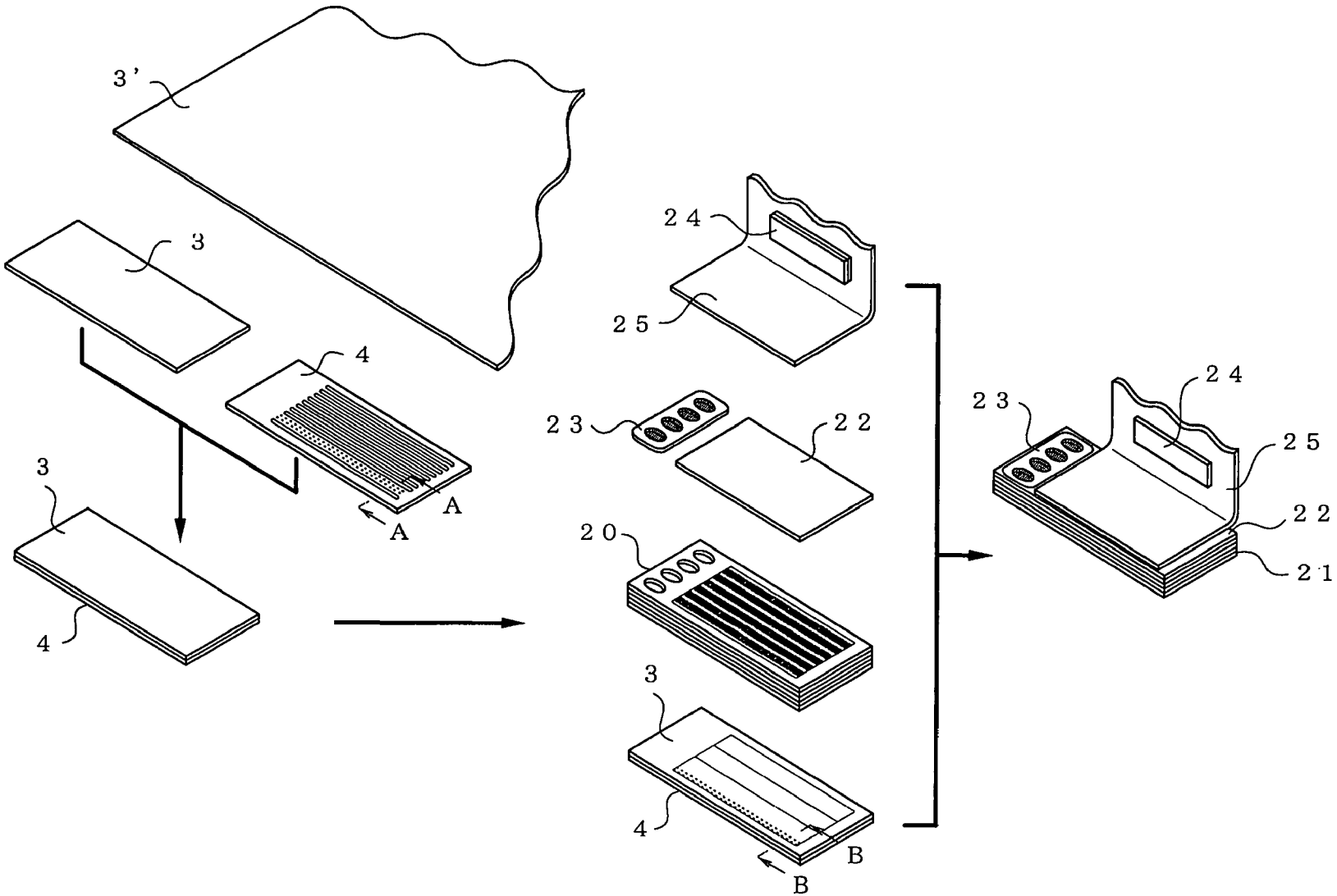
FIG. 2 is a diagram of a method of manufacturing this inkjet printer head.
Figure 3B:
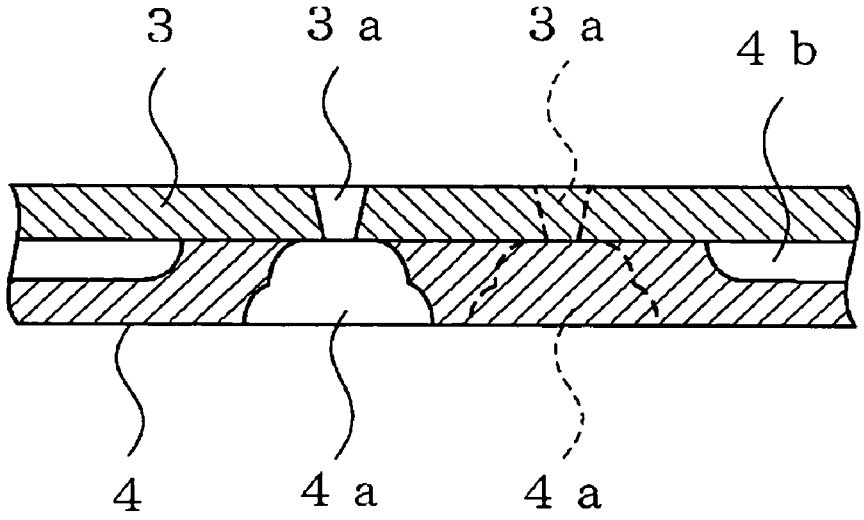
FIG. 3B is a cross-sectional view along the line B-B of FIG. 2.

Such an inkjet printer head is manufactured as shown in FIG. 2. In other words, a synthetic resin film 3' (polyimide film: thickness 75 μm) constituting the nozzle material is cut corresponding to the region of nozzle formation, in order to obtain a rectangular nozzle film 3. After this, an operation is performed of sticking this nozzle film 3 onto the cover plate 4 (see FIG. 3A) provided with the through-holes 4*a* for the recessing of the nozzle holes 3*a* and forming the nozzle holes 3*a* using an excimer laser, from the side of the nozzle film 3. In this way, as shown in FIG. 3B, the nozzle holes 3*a* are formed in the nozzle film 3 in positions corresponding to the through-holes 4*a*. In this way, the nozzle film 3 is stuck onto the cover plate 4 and the nozzle holes are processed. The purpose of this is to prevent the variation of nozzle position precision resulting from expansion and contraction of the nozzle film 3 caused by the fact that the nozzle film 3 is made of synthetic resin of large coefficient of thermal expansion and is moreover hygroscopic. Also, although the nozzle film 3 is highly flexible, which is a factor that makes it difficult to handle and so lowers working efficiency, the nozzle holes 3*a* are formed after uniting the nozzle film with the cover plate 4, which is of high rigidity, so the working efficiency is raised. In other words, the nozzle film 3 is reinforced by the cover plate 4 during manufacture. In this way, at least similar handling properties are obtained to the handling of a metal plate.

After this, from the side of the cover plate 4, water-repellent processing (processing to apply a water-repellent film) including the inside of the through-holes 4*a* is performed and, on the side of the nozzle film 3, the laminate part 20 that has stuck onto it the plates 14 to 19 so as to form beforehand flow paths in their interior, the piezoelectric actuators 22, filter 23 and flexible wiring substrate 25 provided with the driver IC 24 are stuck on or welded on to constitute the inkjet printer head 1. Accordingly, the cover plate 4 that acts as a reinforcement plate for the nozzle formation processing is finally positioned on the side of the nozzle film 3 nearest to the recording medium (see FIG. 1A).

When a drive signal is supplied through the flexible wiring substrate 25 to an inkjet printer head constructed in this way, the ink is ejected from the nozzle holes 3*a* formed in the nozzle film 3 through the communicating holes 14*b* to 18*b* communicating with the pressure chambers 19*a* by the piezoelectric actuators 22. The ink that is then consumed is replenished from the manifold (manifold holes 14*a*, 15*a*) through the communicating holes 16*a*, 18*a* and communicating paths 17*a*.

Even if, during such use, a recording medium in the process of being conveyed were to collide with the nozzle face, there would be no possibility of the nozzle holes 3*a* exposed at least within the through-holes 4*a* being affected thereby, due to the presence of the cover plate 4. Specifically, within the through-holes 4*a*, the water-repellent film that exhibits the desired water-repellence is always present at the periphery of the nozzle holes 3*a*, so an excellent ink projection characteristic is maintained. Also, it could happen that the pressure wave, that is generated when a pressure chamber 19*a* likewise communicating with the manifold ejects ink, is propagated through this manifold to another, different pressure chamber 19*a* in a prescribed positional relationship with the first-mentioned pressure chamber 19*a*. This would give rise to variation in the ink discharge characteristic as between the pressure chambers 19*a*. However, since the bottom face of the manifold is constituted by the nozzle film 3 this acts as a damper, with the result that, even if an unwanted pressure wave were to be propagated through the manifold, it would be damped to a degree such as to have no effect on the discharge characteristic in the other pressure chamber 19*a*. In this embodiment, since the damper is formed of synthetic resin of high flexibility (polyimide film), such a crosstalk effect as described above is substantially absent.

Incidentally, inkjet printers are seldom operated continuously, and so, depending on the length of the rest period, the viscosity of the ink may become too high. Alternatively, bubbles or dirt may penetrate into the inkjet printer head 1 on changing of the ink-tank (not shown) that constitutes the source of supply of the ink. To deal with this, recovery or maintenance of the ink discharge performance is achieved by performing, with prescribed timing, a purging process to remove ink forcibly from the nozzle holes 3*a*.

In this purging process, ink removal is performed by fitting a suction cap onto the nozzle face (surface of the cover plate 4 nearest the recording medium). This tends not only to cause ink to flow out from the nozzle holes 3*a* but also to draw in air present in the cap, creating air bubbles. Also, minute air bubbles mixed with ink droplets adhere to the surface of the cover plate 4, so this nozzle face is wiped with a wiper constituted by a elastic member such as rubber. In this way, the surface of the cover plate 4 is cleaned.

In the embodiment described above, in order to avoid damage to the water-repellent film by friction with the recording medium, a cover plate (reinforcement plate) made of metal is provided in the vicinity of the nozzle holes 3*a*. However, with such a construction, despite the formation of a water-repellent film, ink in the through-holes 4*a* cannot be completely removed by wiping using a wiper immediately after purging.

In addition, if a mixture of minute air bubbles and ink droplets is present as described above within the suction cap after purging, and the nozzle face is opened to the atmosphere after removal of the suction cap, the air bubbles mixed with ink in the vicinity of the nozzle holes 3*a* may be drawn into the interior of the nozzle holes by the difference in head produced between the inkjet printer head 1 and the ink tank, not shown. As a result, air bubbles remain in the ink channel. If air bubbles remain and are mixed with the ink in this way, during printing, the pressure wave generated by the piezoelectric actuator is damped, so in some cases stable discharge may not be achievable. Measures are therefore taken to recover performance, such as using ink in a de-aerated condition or dissolving bubbles that have become mixed therewith, but these require a prescribed time before printing can be performed.

Figure 4A:
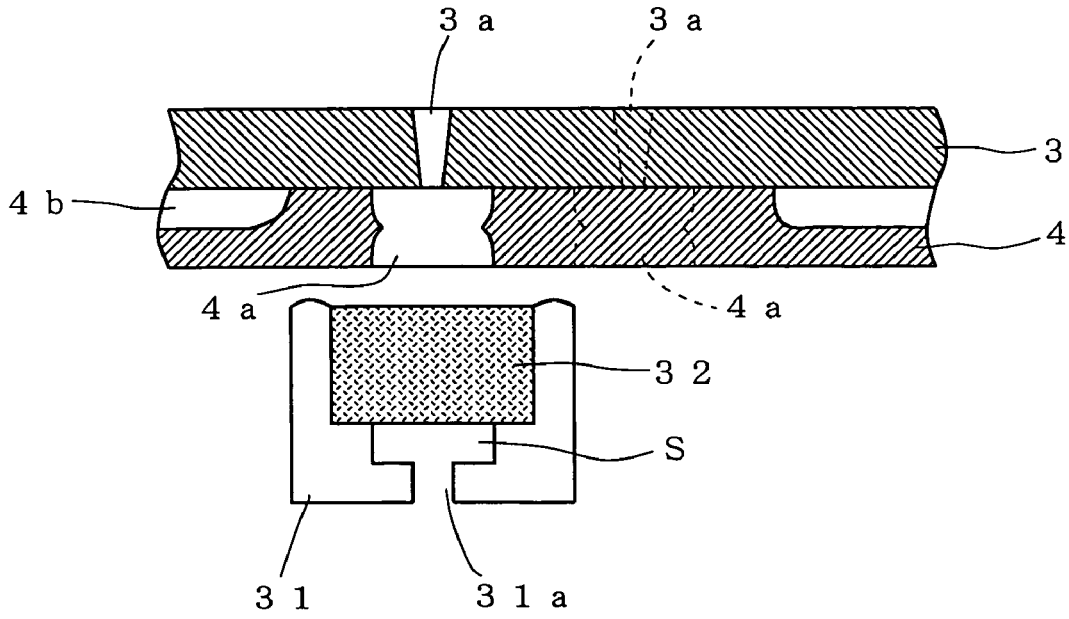
FIGS. 4A, 4B and 4C show the operation of a suction cap, FIG. 4A being a diagram illustrating the condition prior to contact with the nozzle face, FIG. 4B being a diagram illustrating the contacting condition and FIG. 4C being a diagram illustrating another contacting condition.
Figure 4B:
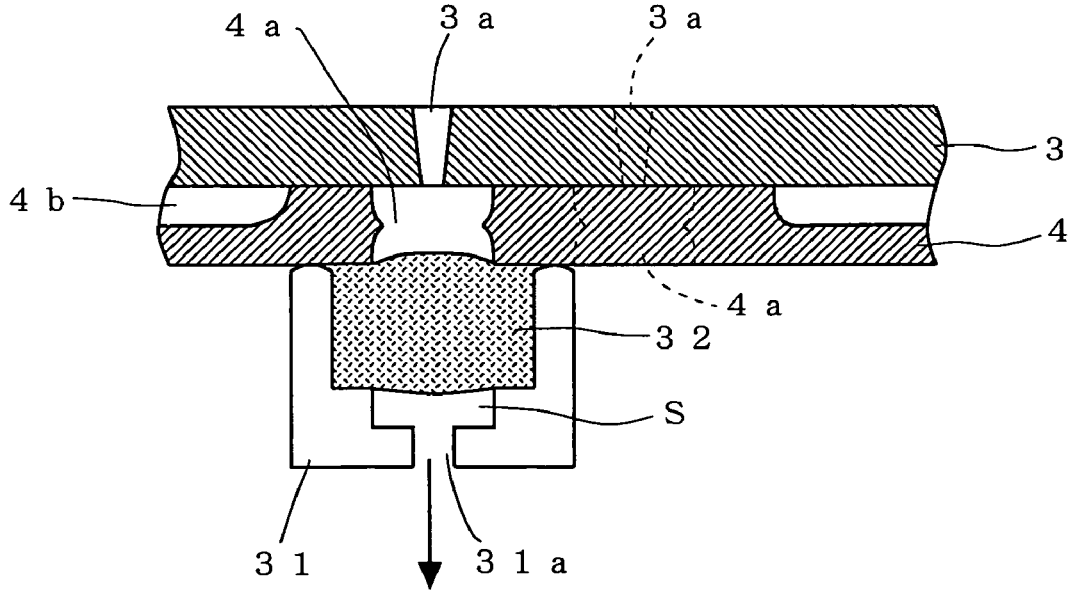

A construction of the suction cap as shown in FIGS. 4A and 4B is therefore adopted such as to produce a condition in which very little ink is drawn into the nozzle holes after purging and, furthermore, no minute air bubbles are admixed with this ink.

Specifically, water absorbent material 32 in the form of a sponge constituted by a porous member is arranged within a suction cap 31 provided with an annular wall. This is shown in FIG. 4A. A construction is adopted in which the surface of this water absorbent material 32 is of equivalent height to that of the lip face of the suction cap 31 or is higher than this, and in which a space S in which no water absorbent material 32 is disposed is left at the rear face thereof, this space S being connected with a suction pump (not shown). When this suction cap 31 is brought into contact with the nozzle face, the lip face is compressed by the contacting force thereof. Consequently, not merely the lip face but also the water absorbent material 32 comes into contact with the nozzle face and, in addition, this water absorbent material 32 effects contact in planar fashion. Also, as shown in FIG. 4B, since the water absorbent material 32 is deformed by protruding in the form of a projection on the inside of the nozzle holes 3*a*, the spatial volume created by the through-holes 4*a* is reduced corresponding to the amount of the projection of the water absorbent material 32.

That is, in an inkjet printer that performs recording on a recording medium using an inkjet printer head constructed as described above, as maintenance means for recovery and maintenance of performance in respect of discharge of the ink from the nozzle holes, a suction cap for contacting the ink discharge face and effecting forcible suctional discharge of ink comprises an annular wall that is elastically deformed by contact with the ink discharge face and a porous member arranged at an equivalent height, in the height direction, to the contacting face (lip face) with respect to this ink discharge face in this annular wall, or projecting thereabove.

In this way, the spatial volume in the vicinity of the nozzle holes 3*a* is reduced by the provision of the water absorbent material 32 and generation of air bubbles is considerably decreased. That is, any air bubbles that are generated in the initial period of purging are discharged to the outside together with ink, and at least whilst the negative pressure created by the suction pump is functioning effectively for ink removal, the small chambers (through-holes 4*a*) in the vicinity of the nozzle holes 3*a* are filled with ink. This prevents any air bubbles from being generated thereafter. In addition, the water absorption force (negative pressure) of the water absorbent material 32 is added to the suction pressure of the purging in the initial period of purging, so purging is assisted by the negative pressure force of the water absorbent material 32; consequently, more powerful purging can be effected. Also, when the suction cap 31 is removed, further water absorbing force is generated by swelling up of the water absorbent material 32 which was previously compressed, so that remaining ink (air bubbles likewise) in the aforesaid small chambers is sucked up, making it possible to greatly reduce the amount of ink left behind in the nozzle holes 3*a*. Once the ink has transferred to the water absorbent material 32, it tends to migrate to the inside of the water absorbent material 32, so the amount of residual ink at the nozzle face contacted by this water absorbent material 32 can be greatly reduced.

Accordingly, in some cases, it is possible to dispense with the wiper or wiper mechanism, which is advantageous in regard to cost reduction.

Besides the above embodiment, the present invention may be constituted as follows.

Figure 1B:
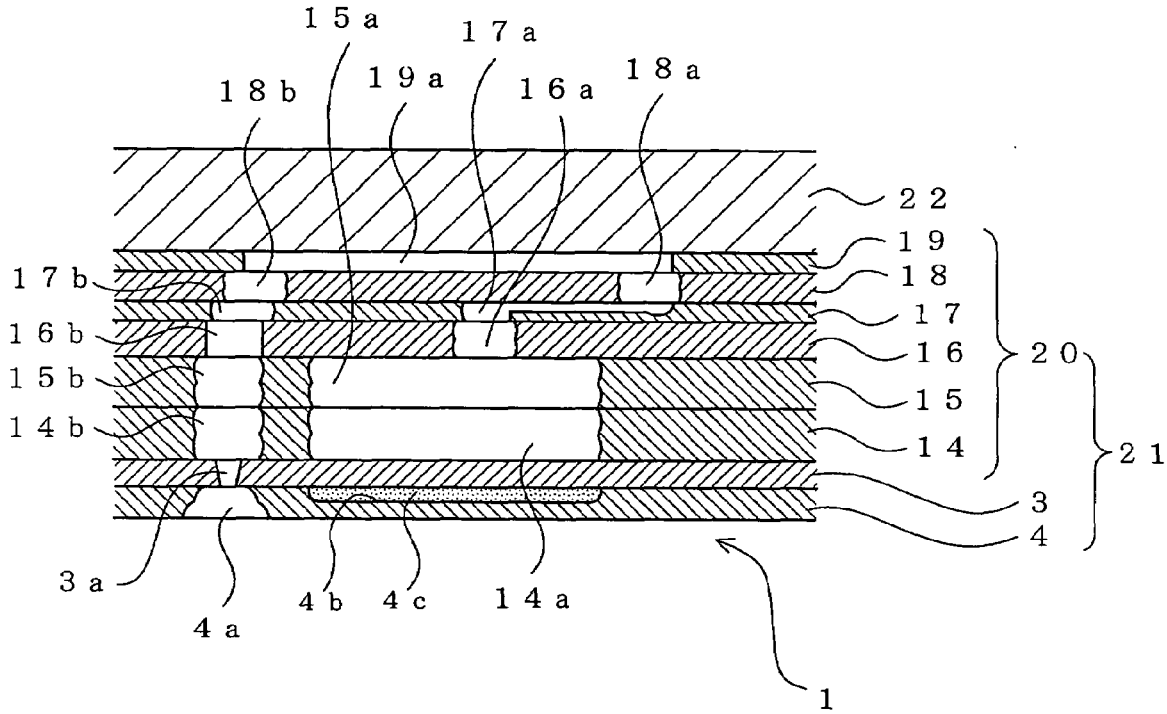
FIG. 1B is a cross-sectional view showing the construction of an inkjet printer head according to another embodiment of the present invention.

(i) In the above embodiment, the recesses 4*b* of the cover plate 4 (reinforcement plate) were merely for forming damper chambers constituting enclosed spaces sealed by one face of the nozzle film 3, but as shown in FIG. 1B, it is also possible to enclose an elastic member 4*c* such as a silicone sealing member with the aforesaid damping chamber, in order to prevent penetration of air through the nozzle film 3 into the manifold or evaporation of moisture from the ink in the manifold.

(ii) In the above embodiment, a construction was adopted in which the through-holes 4*a* of the cover plate 4 (reinforcement plate) became gradually larger in aperture area towards the nozzle film 3 from the side of the recording medium, but this is not necessarily essential and the through-holes 4*a* could be constructed as through-holes that become larger in stepwise fashion, or could be constituted as through-holes of substantially the same diameter.

Figure 4C:
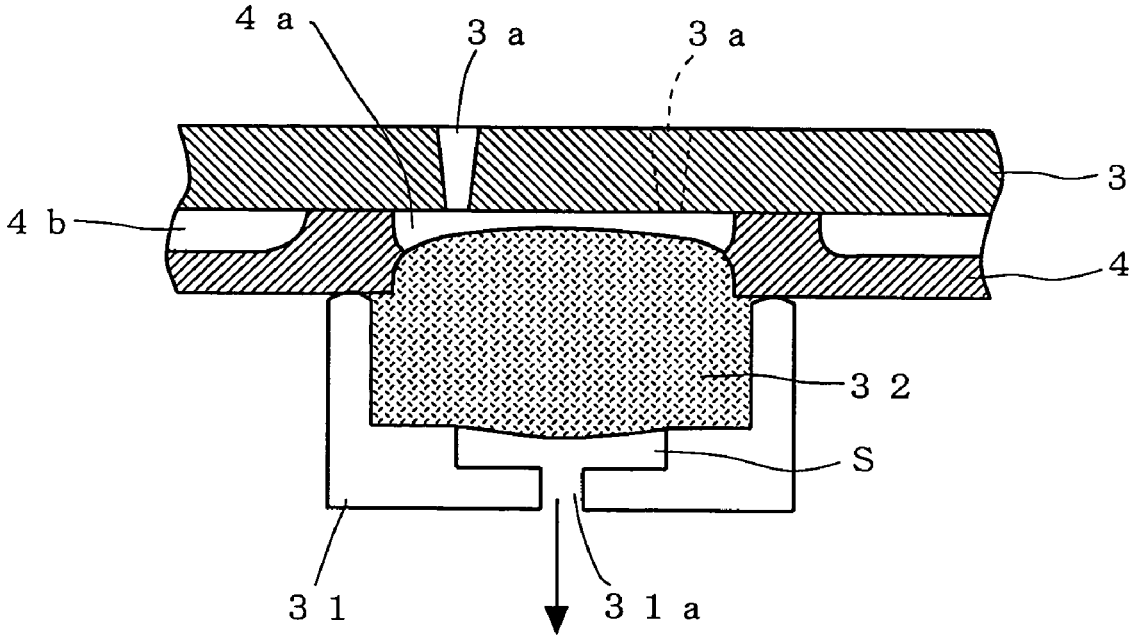

(iii) In the above embodiment, a construction was adopted in which one through-hole 4*a* was provided for one nozzle hole 3*a*, but this is not necessarily essential and as shown in FIG. 4C, it would also be possible to adopt a construction in which a plurality of adjacent nozzle holes 3*a* constitute one group and one common through-hole is provided in respect of these. For example, in respect of two nozzle rows which adjoining each other and constitute one group (for one color) and in which the nozzle holes 3*a* are arranged in a zigzag fashion, one common through hole 4*a* is provided in the cover plate (reinforcement plate) 4. In this way, the aperture area of the through-holes 4*a* becomes larger, so if maintenance means as described above is employed, the water absorbent material 32 reaches the vicinity of the nozzle holes 3*a*, making it possible to remove ink reliably from the through-holes 4*a*.

(iv) In the above embodiment, the cover plate 4 (reinforcement plate) is provided with a water-repellent film on the entire surface on the side nearest the recording medium, including the insides of the through-holes 4*a*, but this is not necessarily essential and it suffices to form the water-repellent film on the inside of the through-holes 4*a* (inner peripheral surface of the through-holes 4*a* and surface of the nozzle film 3 within the through-holes 4*a*). It is even possible to provide the water-repellent film solely on the surface (surface of the nozzle film 3) at the periphery of the nozzle holes 3*a*. This water-repellent film not only plays an important role in stabilizing the ejecting characteristics of the ink during recording but also, during maintenance, promotes removal of the ink within the through-holes 4*a* by the water absorbent material 32, irrespective of the mode of the through-holes 4*a*.

(v) In the above embodiment, the manifold plates 14 and 15 were constituted as two superimposed plates, but it would also be possible to employ a single thick plate as a manifold plate, or, contrariwise, to employ three to four thin plates as a manifold plate.

(vi) In the above embodiment, the nozzle film was stuck onto a cover plate 4 provided with through-holes for processing of the nozzle holes and the nozzle holes were formed using an excimer laser from the side of the nozzle film 3. However, in order to prevent bending back due to input of heat by the laser processing, it would also be possible to construct a body of sandwich structure in which the nozzle film 3 is sandwiched by a cover plate 4 and a manifold plate 14, and the nozzle holes are formed by the excimer laser from the side of the manifold plate 14 where apertures larger than the nozzle holes are formed in positions corresponding to the nozzle holes. In this case, the cover plate 4 and the manifold plate 14 may of course be metal plates of the same material and the same plate thickness, but it is sufficient if at least their linear expansion coefficients are substantially the same. In this case, the nozzle holes 3*a* can be formed while confirming the position of the communicating holes 14*b* formed in the manifold plate 14, so the precision of their forming positions is increased.

(vii) For the actuators, individual piezoelectric elements may be arranged at each of the pressure chambers, or another type of actuator may be employed.

(viii) In the above embodiment, the damper chambers created by the nozzle film 3 and the recesses 4*b* of the cover plate 4 may be arranged to communicate with the atmosphere in order to improve the damping effect. For example, in addition to the channels through which the ink flows, an atmosphere communication path that communicates with the atmosphere may be formed within the laminate part 20 that is stuck onto the nozzle film 3. In this way, it is appropriate to form its open end at the surface on the side where the piezoelectric actuators are stuck on, in order to ensure that there is no penetration of ink into this atmosphere communication path.

Figure 1C:
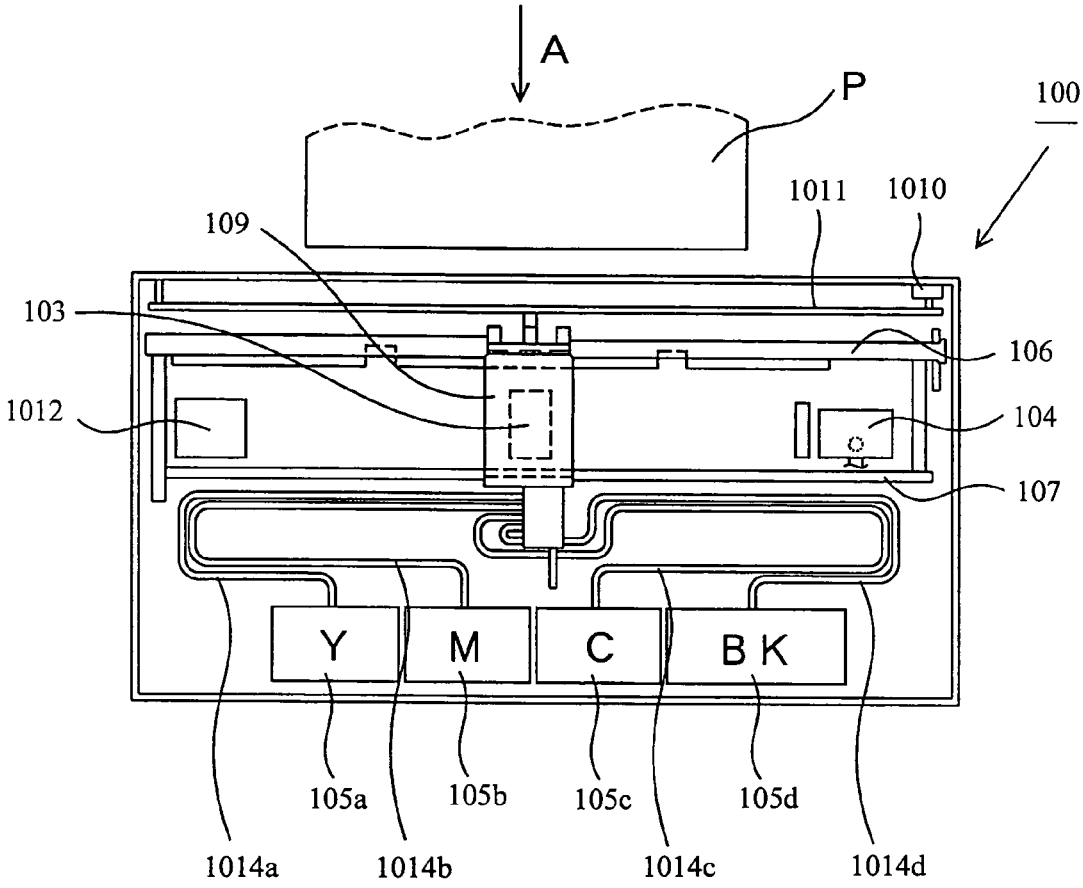
FIG. 1C is a plan view illustrating an ink jet printer according to a preferred embodiment of the present invention.

An embodiment of an inkjet printer provided with the inkjet printer head of the present invention will be describer by referring to FIG. 1C.

In FIG. 1C, two guide shafts 106, 107 are provided in the interior of an inkjet printer 100, and a carriage 109 is mounted on the guide shafts 106, 107 so as to be capable of movement along the guide shafts 106, 107. The inkjet printer head 103 for performing recording by discharging ink onto recording paper P is mounted detachably onto the carriage 109. The recording paper P is conveyed in a direction shown by an arrow A in FIG. 1C by a conveyance device not shown in the drawing. The carriage 109 is mounted on an endless belt 1011 that is rotated by a motor 1010, and according to drive of the motor 1010, the carriage 109 performs a reciprocating motion along the guide shafts 106, 107 in an orthogonal direction to the conveyance direction. When recording is performed on the recording paper P, the conveyance of the recording paper P and the reciprocating motion of the carriage 9 are performed in conjunction.

The inkjet printer 100 further comprises an ink tank 105*a* storing yellow ink, an ink tank 105*b* storing magenta ink, an ink tank 105*c* storing cyan ink, and an ink tank 105*d* storing black ink. The ink tanks 105*a* to 105*d* are connected to the inkjet printer head 103 by flexible ink supply tubes 1014*a*, 1014*b*, 1014*c*, 1014*d*, respectively. The ink of each color used in the inkjet printer head 103 is supplied through the ink supply tubes from each ink tank.

A flushing portion 1012 is provided at one end of the movement direction of the carriage 109, and a maintenance portion 104 is provided at the other end. The ink jet head 103 discharges defective ink containing air bubbles or the like to the flushing portion 1012 in order to maintain a favorable ink discharge performance. The maintenance portion 104 aspirates ink containing air bubbles, wipes the nozzle face, and so on in order to maintain a favorable ink discharge performance.

The entire disclosure of the specification, claims, drawings and summary of Japanese Patent Application No. 2004-281516 filed on Sep. 28, 2004 is hereby incorporated by reference.

What is claimed is:

1. An inkjet printer head for performing recording by ejecting ink onto a recording medium, comprising: a cavity unit including a plurality of nozzle holes for ejecting the ink, a plurality of pressure chambers communicating with each of said nozzle holes, and a manifold that temporarily accumulates the ink that is supplied to said pressure chambers; and actuators that eject the ink from said nozzle holes, wherein:

said cavity unit comprises at least a laminate comprising a nozzle film made of a synthetic resin and provided with said plurality of nozzle holes, a reinforcement plate stuck onto one face of said nozzle film and arranged facing said recording medium, and a manifold plate stuck onto the other face of said nozzle film and provided with manifold holes constituting said manifold; and said reinforcement plate is provided with a through-hole passing therethrough facing each nozzle hole, and a recess that opens facing towards said manifold holes through said nozzle film.

2. The inkjet printer head according to claim 1, wherein, when viewed in the direction of lamination of said laminate, said through-hole has an aperture area larger than said nozzle hole and said recess has the same shape and the same size as said manifold holes.

3. The inkjet printer head according to claim 2, wherein said recess forms a damper chamber that is sealed by one face of said nozzle film, and an elastic member is enclosed with said damper chamber.

4. The inkjet printer head according to claim 3, wherein said elastic member is a silicone sealing member.

5. The inkjet printer head according to claim 1, wherein the aperture area of said through-hole becomes larger gradually or in stepwise fashion towards the outside.

6. The inkjet printer head according to claim 1, wherein one through-hole is provided for a plurality of adjacent nozzle holes.

7. The inkjet printer head according to claim 1, wherein said reinforcement plate is provided with a water-repellent film at least on the inside of said through-hole.

8. The inkjet printer head according to claim 1, wherein said reinforcement plate and said manifold plate are made of the same material.

9. The inkjet printer head according to claim 1, wherein said reinforcement plate is made of a metal material.

10. The inkjet printer head according to claim 9, wherein said metal material is a 42% nickel alloy steel plate.

11. The inkjet printer head according to claim 1, wherein said manifold plate is provided with communicating holes communicating with said nozzle holes, and the aperture diameter of said communicating holes are the same as that of the through-hole of the reinforcement plate.

12. An inkjet printer, comprising the inkjet printer head of claim 1.

13. The inkjet printer according to claim 12, further comprising a suction cap within which a porous member is arranged so that it may be brought into contact with one face of the reinforcement plate of the inkjet printer head.

14. The inkjet printer according to claim 13, wherein the suction cap can be brought into contact with the reinforcement plate and further comprises an annular wall that is elastically deformed by contact with the reinforcement plate, and the porous member is arranged at an equivalent height, in the height direction, to the contacting face of the reinforcement plate or projecting thereabove.

* * * * *